US005944336A

United States Patent [19]

Fagot

[11] Patent Number: 5,944,336

[45] **Date of Patent: *Aug. 31, 1999**

[54] BOARD FOR GLIDING ON SNOW, INCLUDING A DEVICE FOR MOUNTING A BOOT BINDING

[75] Inventor: Jacques Fagot, Saint Jean de Moirans, France

[73] Assignee: Skis Rossignol S.A., Voiron, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/651,854

[22] Filed: May 21, 1996

[30] Foreign Application Priority Data

May 22, 1995 [FR] France ..... 95 06335

[51] Int. Cl.[6] ..... A63C 5/00

[52] U.S. Cl. ..... 280/607; 280/610

[58] Field of Search ..... 280/607, 617, 280/608, 610

[56] References Cited

U.S. PATENT DOCUMENTS

| | | | |
|---|---|---|---|
| 5,333,889 | 8/1994 | Piegay et al. | 280/610 |
| 5,372,370 | 12/1994 | Rohrmoser | 280/610 |
| 5,393,086 | 2/1995 | Le Masson et al. | 280/607 |
| 5,397,150 | 3/1995 | Commier et al. | 280/607 |
| 5,447,332 | 9/1995 | Le Masson et al. | 280/607 |
| 5,458,358 | 10/1995 | Garcin et al. | 280/608 |
| 5,544,908 | 8/1996 | Fezio | 280/610 |
| 5,655,787 | 8/1997 | Piegay | 280/607 |
| 5,788,259 | 8/1998 | Emig | 280/610 |

FOREIGN PATENT DOCUMENTS

| | | | |
|---|---|---|---|
| 0590044 | 6/1992 | European Pat. Off. . | |
| 288757 | 6/1953 | France . | |
| 2590179 | 5/1987 | France . | |
| 2635013 | 2/1990 | France | 280/607 |
| 2638651 | 11/1990 | France . | |
| 2660384 | 10/1991 | France . | |
| 2664823 | 1/1992 | France . | |
| 473593 | 7/1969 | Switzerland | 280/608 |
| WO 94 05382 | 3/1994 | WIPO . | |

*Primary Examiner*—Thomas J. Brahan
*Attorney, Agent, or Firm*—Oliff & Berridge, PLC.

[57] ABSTRACT

A board for gliding on snow, such as a ski, comprises, in its support region, a device for mounting a boot binding. The device comprises at least one lower element that bears on the lower edge of the board and may laterally cover the edge, at least one upper element that forms a platform for mounting a boot binding, and at least one connecting element between each lower and upper element. Each lower element is supported by the corresponding lower edge of the board, and the assembly of the lower element, the connecting element, and the upper element is rigid.

26 Claims, 3 Drawing Sheets

BOARD FOR GLIDING ON SNOW, INCLUDING A DEVICE FOR MOUNTING A BOOT BINDING

BACKGROUND OF THE INVENTION

The subject of the present invention is a board for gliding on snow, including a device for mounting a boot binding. The board according to the invention may be an alpine ski, a cross-country ski, a monoski or a snowboard, mainly a board consisting of a shell, that is to say one which does not have wide lateral reinforcing elements or sidepieces, it being, however, possible for the shell to be lined with a reinforcing fabric.

DESCRIPTION OF THE PRIOR ART

A ski is traditionally equipped with a boot binding on its upper face, this binding most often having a toe piece and, in the case of an alpine ski, a heel piece, which are placed on the upper face of the ski and are fixed by screwing into the body of the ski.

Very schematically, an alpine ski according to the invention comprises of a lower assembly composed of a sole bordered by metal edges and optionally covered with a reinforcing element, and of an upper assembly composed of at least one filler core, a reinforcing element and an outer casing made of a part in the form of a shell.

In the case of a shell ski, the base of the shell very often comprises of two sides bearing over a part of their width on the lower assembly, that is to say either directly an the metal edges or on the reinforcing element covering these edges or, finally, on an intermediate film (adhesive film or elastic film). In such a shell ski, because of the offset of the edges outward relative to the surface supporting the foot on the skier, and because the side walls of the shell, even when combined with reinforcing elements, have moderate rigidity, the efficiency of support on the edges is limited, in particular in the region where the binding is mounted, which is subjected to the transfer of forces between the foot of the ski and the snow.

In order to ensure that the ski is guided correctly, it is important for the forces to be transferred as directly as possible between the boot of the skier and the ski edge bearing on the snow. However, the large number of structural elements of the ski through which the forces must pass between the snow and the boot constitutes efficiency loss zones, which is an unfavorable factor for correct guiding of the ski.

This phenomenon is amplified when a raising device is used for mounting the boot binding.

Because current skis are narrower in the support region, that is to say the region where the bindings are mounted, than previously, the boot protrudes on either side of the side walls of the ski. The result of this is that, when the edges are set on a steep slope, the boot may bear on the surface of the snow, which results in an imbalancing of the skier which way cause him to fall, or at the very least cause him to lose time, which is detrimental during a race.

In order to overcome this drawback, consideration has been given to mounting a raised plate on the upper face of the ski, this plate to tilt through a larger angle relative to the snow before the sole of the boot bears on the surface of the latter.

Document CH 288 757 relates to an entirely metal ski comprising a substantially plane lower band forming the gliding surface and an upper band, of generally trapezoidal cross section, fixed on the lower band and providing torsional stiffness. In the central part of the ski, on the upper band, a bearing plate used for mounting the boot binding is fixed by means permitting longitudinal relative displacement. Since this connection is a sliding connection, it does not permit direct and therefore efficient application onto the lower corners of the ski of the forces exerted by the user.

Some plates are made of metal and are fixed simply on the upper face of the ski, merely forming spacers between this upper face and the baseplate of the toe piece or of the heel piece.

It is also known to fix on the upper face of the ski a raised plate consisting of a layer of viscoelastic material, bonded onto the ski, and covered with a stress plate. Various embodiments relying on this basic design can be envisaged, as described, in particular, in documents FR-A-2 638 651 and FR-A-2 664 823.

Further to the raising of the boot relative to the snow, such a solution makes it possible to provide an effect of unclamping the boot relative to the ski, and also a damping effect, in particular by shearing of the layer of viscoelastic material between the upper face of the ski and the stress plate. When a ski flexes, the toe piece and the heel piece constituting the binding move toward each other, which exerts a pressure on the sole of the boot, resulting in the ski being stiffened in this region and therefore the behavior of the ski being modified relative to its theoretical behavior. It is therefore beneficial to avoid this phenomenon by providing a degree of unclamping of the boot/binding assembly relative to the ski, giving back the latter freedom to deform.

It is also known from document EP-A-0 490 044 to produce a ski consisting of a first lower assembly, or base, and a second upper assembly, or stiffener, fixed on the base. The stiffener acts as a long platform on which the boot binding is mounted.

In the solutions set out above, the binding is mounted on an element which is itself fixed on the upper face of the ski. However, in order to ensure the best possible guiding of the ski, it is important for the forces to be transferred as directly as possible between the ski edge bearing on the snow and the boot of the skier. Yet the interposition of a raised platform increases the number of elements through which the forces must be transferred between the snow and the boot, which constitutes a factor which is unfavorable for correct guiding of the ski.

Document FR-A-2 590 179 describes a cross-country ski containing a stabilization plate which is arranged inside the ski, under the upper wall of the latter, and the ends of which are bent toward the sole. At least along one of its longitudinal edges, this plate has a downward extension arranged inside the ski and forming an angle of from 5 to 45° with the corresponding side wall of the ski.

SUMMARY OF THE INVENTION

The object of the invention is to provide a shell gliding board equipped with a device for mounting the boot fastening which ensures the most direct possible transfer forces between the snow and the boot of the skier.

To this end, the ski to which it relates, of the type comprising a lower assembly composed of a sole bordered by lower corners and, optionally, a reinforcing element, and an upper assembly composed of at least one filler core, a reinforcing element and an outer casing comprising a shell forming the upper wall on the side walls of the ski, which board comprises, in the central part or support region of the ski:

at least one lower element, in the form of a foot, located on at least one side of the ski, outside the body of the latter, either bearing on the lower assembly directly or via the sides of the shell, or laterally covering the lower assembly, at least one upper element which, arranged above the upper wall of the ski or level with this wall, forms a rigid platform for mounting the binding, and at least one connecting element between each lower element and each upper element, and arranged outside the body of the ski, wherein each lower element is rigidly connected to the corresponding lower corner of the board, and wherein the assembly consisting of the lower element, the connecting element and the upper element is rigid, that is to say nondeformable.

The force exerted by the foot of the skier is transferred to the lower corners of the ski directly through the device for mounting the binding, composed of the platform, the connection and at least one foot. In such a case, the force therefore does not pass through the structure of the ski, and therefore through the various components thereof which may absorb some of this force. The upper part, or platform, is either raised relative to the upper surface of the shell or in contact with the latter or, finally, fitted into a housing provided in this upper surface.

Advantageously, in the regions containing the lower elements, the connecting elements and the upper element, the shell has inward recesses forming passages for the lower elements, the connecting elements and, optionally, the upper element.

According to a first embodiment, in each region of the shell intended to accommodate a lower element in the form of a foot, the lower element defines a horizontal surface used for supporting a lower element in the form of a foot.

According to a second embodiment, the lower assembly has a recess locally interrupting the horizontal surface, and the lower element in the form of a foot itself constitutes the lower corner of the ski.

According to one embodiment of this ski, the lower and connecting elements and the platform comprise at least one monobloc piece in the general shape of an inverted U.

According to another embodiment, the lower, connecting and upper elements consist of a monobloc piece of cross section in the general shape of an L, one flank of which is associated with the upper face of the ski and the other flank of which is associated with the lower side wall of the ski, when considering the two skis of the same pair placed one beside the other.

The upper flank may be in contact with the upper face of the ski or arranged above the latter, with or without the interposition of a layer of viscoelastic material. The vertical flank is advantageously fixed by bonding against the corresponding side wall of the ski.

In the case of a board including a shell whose side walls are inclined downward and outward in the regions containing the lower elements and the connecting elements, the inclination of the side walls of the shell becomes closer to the perpendicular to the plane of the sole and is associated with a width reduction of the lower part of the body of the ski in order to permit a larger bearing area for the lower elements on the lower assembly of the ski.

According to one embodiment of this ski, the lower element or elements, the connecting element or elements and the upper element extend over the entire length where the boot binding is mounted, the upper element forming a continuous platform According to the monobloc assembly configuration, the lower and connecting elements are merged.

Insofar as the ski includes a monobloc element of U-shaped cross section, the connecting and lower elements include slots distributed over its length and terminating in its lower extremity, substantially perpendicularly thereto. These slots allow the device for mounting the bindings to flex longitudinally, thus preventing the ski from being clamped in the binding region, as would be the case if the connecting elements were continuous and extended over the entire length of the device.

According to another embodiment of this ski, in the case of an alpine ski, the lower elements, the connecting element or elements and the upper element are arranged in two separate longitudinally offset subassemblies, the front one of which is used for mounting the toe piece and the rear one of which is used for mounting the heel piece of the binding.

According to one possibility, the raising device is asymmetrical with respect to the longitudinal midplane of the ski. For example, the number and the longitudinal position of the various connecting and lower elements differ along the two sides of the platform.

According to another embodiment, the platform is longer than the lower elements in the form of feet and protrudes longitudinally on either side of them.

Advantageously, in the case when the platform is arranged above the upper face of the ski, a layer of viscoelastic material is interposed between the upper face of the ski and the platform.

The platform may be used for mounting a standard binding, for example one that is screwed, or may consist of a slide channel forming the base accommodating the body of the boot binding, toe piece or heel piece. This second solution makes it possible to limit the number of pieces forming the assembly, since only a single piece is used both as platform and as the longitudinal slide channel in which the binding body is mounted adjustably and in known fashion.

In any case, the invention will be better understood with the aid of the description which follows, with reference to the appended schematic drawing representing several embodiments of this ski by way of nonlimiting examples:

DESCRIPTION OF THE PREFERRED EMBODIMENTS

Figure 1:
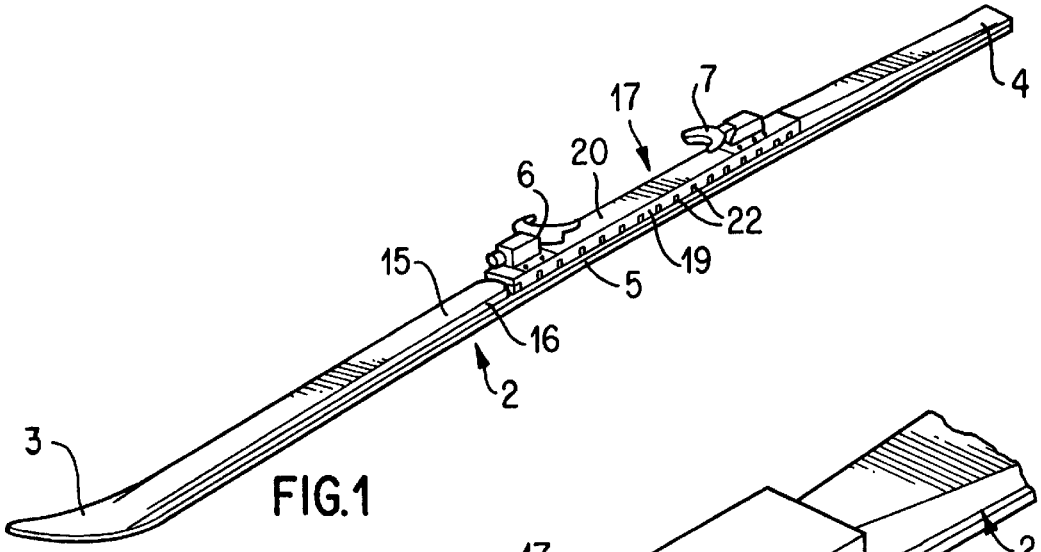
FIG. 1 is a perspective view of a first ski, equipped with a platform extending throughout the region for mounting the bindings.
Figure 4:
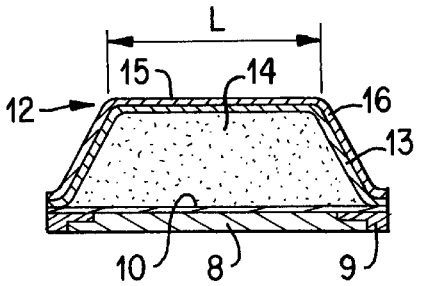
FIGS. 4 and 5 are two cross-sectional views of the ski in FIG. 3, respectively along the lines IV—IV and V—V in FIG. 3.
Figure 5:
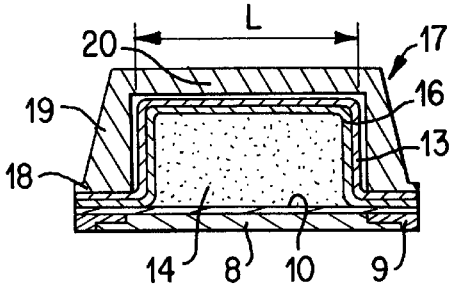

FIG. 1 represents an alpine ski 2 having a tip 3, a heel 4 and a central part or support region 5, intended to receive a boot binding including a toe piece 6 and heel piece 7. As more especially shown in FIG. 4, the ski in question includes a lower assembly composed of a running sole 8, longitudinal metal edges 9 arranged on either side of the sole, and a lower reinforcement 10. The upper part of the ski, that is to say the upper wall and the side walls thereof, is defined by a shell 12 whose lower face is combined with a reinforcing element 13. The core of the ski is, for example, made of expanded synthetic foam 14. As can be seen from the drawing, the shell 12 has an upper wall 15 which, seen in cross section, is substantially parallel to the running sole 8, and two side walls 16 which are each inclined downward, that is to say the upper wall 15 toward the sole 8, and outward. In the central part of the ski, the upper wall 15 has a width L. In this central part and, more precisely, in the region where the binding is mounted, this width L remains constant, but the inclination of the side walls 16 becomes closer to the perpendicular to the plane of the sole, with a contraction in the width of the body of the ski, in the lower part thereof. As shown in FIG. 5, the result of this form is the arrangement of horizontal flanks on either side of the body of the ski. In the embodiment represented in FIG. 1, these two horizontal flanks are used for mounting a piece 17 in the shape of an inverted U, the ends 18 of whose branches form lower elements intended to bear on the horizontal flanks, and whose branches 19 constitute elements for connection with an upper element 20 forming a platform for mounting the toe piece 6 and the heel piece 7. The recesses arranged laterally on the body of the ski make it possible to accommodate the branches 19 without them protruding on either side of the sole of the ski. Although, in the embodiment represented in FIG. 5, the lower ends 18 of the branches 19 bear on the shell, they could equally well bear directly on the lower assembly, that is to say on the edges 9 or on reinforcing elements, such as the reinforcing element lo or the reinforcing element 13. In order to promote flexibility of the raising device, the branches 19 constituting the intermediate elements include slots 22 terminating at the bottom. It would also be possible to lighten the branches 19 fully by retaining only parts 23 forming pillars at the ends.

Figure 2:
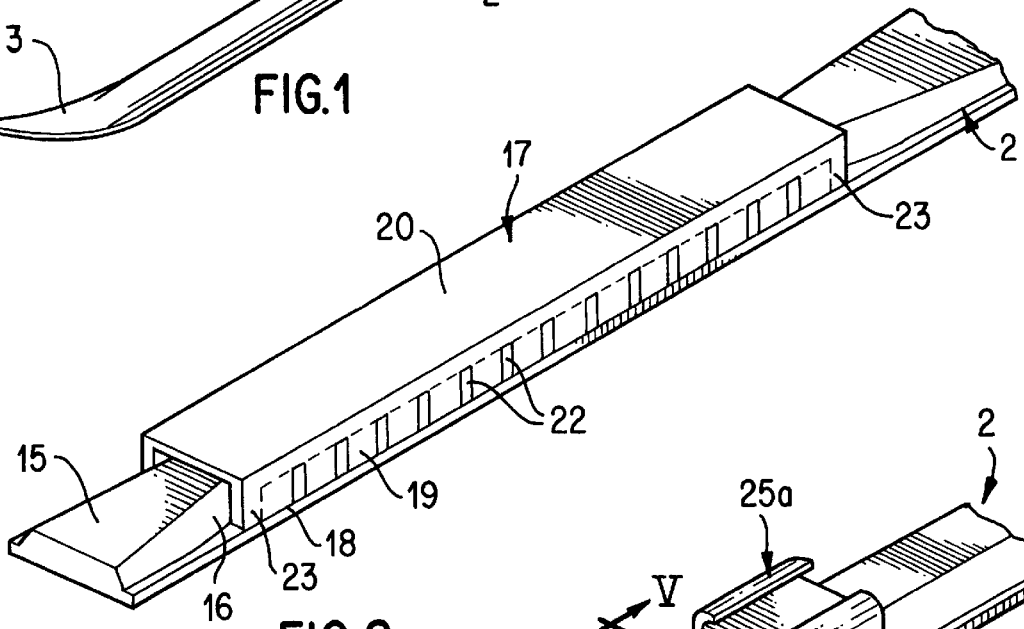
FIG. 2 is a perspective view, on an enlarged scale, of the central part or support region of the ski in FIG. 1.
Figure 3:
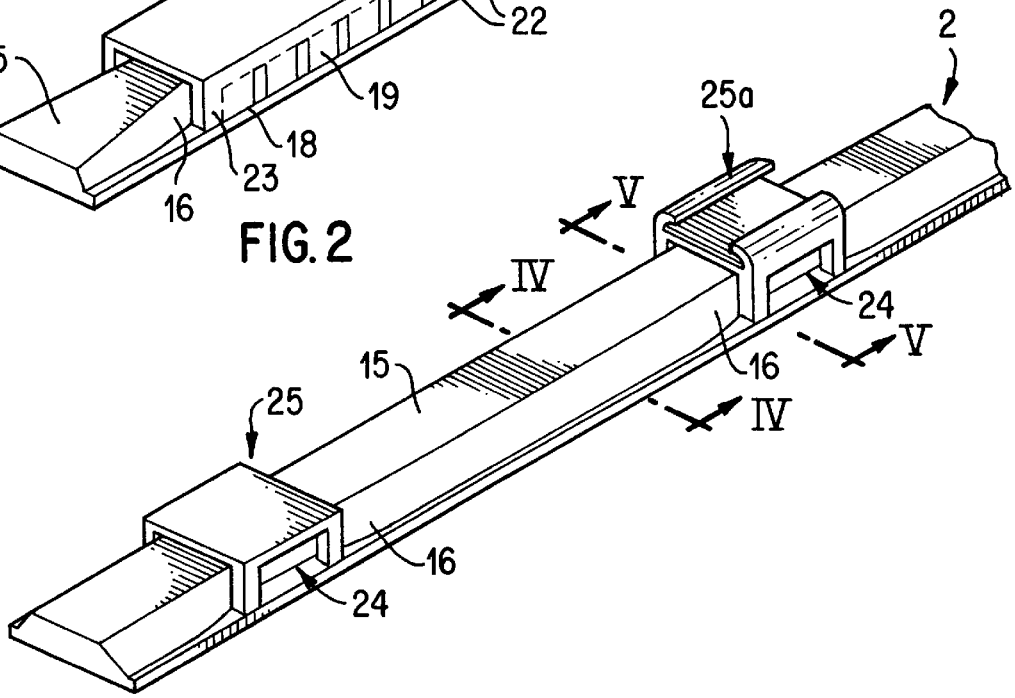
FIG. 3 is a perspective view, similar to FIG. 2, of another ski.

FIG. 3 represents an alternative embodiment of FIGS. 1 and 2, in which the body of the ski has two contracted parts 24, at each of which is arranged a piece forming a small platform, respectively 25 and 25*a* for mounting the toe piece 6 and the heel piece 7. The piece 25 is similar to the piece 17 defined above, with the exception that its dimensions are reduced. The piece 25*a* includes of a slide channel 25*b* which is open at the top, forming a base for the longitudinally adjustable mounting of the body of the heel piece of the binding.

Figure 6:
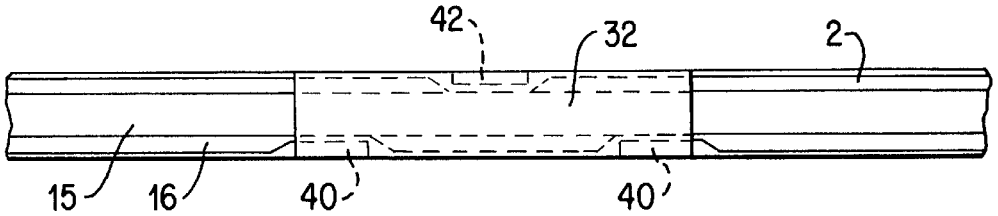
FIG. 6 is a plan view of the central part of the ski equipped with an asymmetrical raising device for the mounting of a binding.

FIG. 6 represents a plan view of the central part of another ski having a raising device which is asymmetrical relative to the longitudinal mid-plane of the ski and includes of a platform 32 bearing on the edges via two feet 40, located close to its two ends along one of the sides of the ski, and via a single foot 42 located substantially half way along the other side of the ski. Since the two devices corresponding to the two skis of the same pair are symmetrical with respect to a longitudinal mid-plane passing between the two skis, it is possible to modify the behavior of the skis by interchanging the two skis of the same pair. If the sides each having two feet 40 are located on the inside, the skis behave well in turns with a large radius of curvature, as is the case in giant slalom, whereas if the sides each having one foot 42 are located on the inside, the skis behave well in turns with a smaller radius of curvature, as is the case in slalom.

Figure 7:
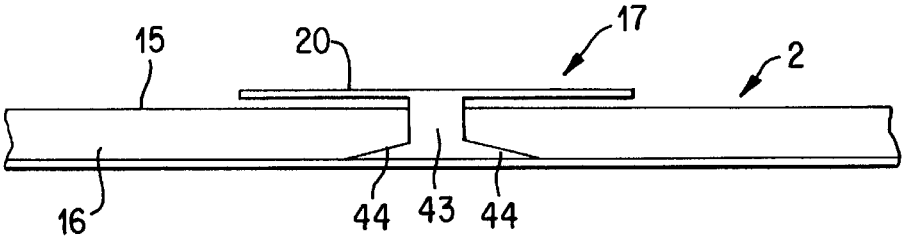
FIG. 7 is a side view of another ski.

FIG. 7 represents another ski, seen from the side, in which the raising element, seen in cross section, has a U-shape, composed of a platform 20 combined by a connection element 43 with lower elements 44 in the form of feet, bearing on the edges, each element 44 centered on the platform 17 being shorter than the latter. The platform 17 is therefore mounted so as to overhang with respect to the feet 44.

Figure 8:
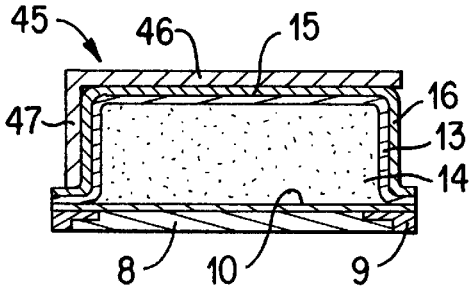
FIGS. 8 to 10 are cross-sectional views, similar to FIG. 5, of three other embodiments of this ski.

FIG. 8 represents another embodiment of this ski, in which the same elements are denoted by the same references as before. In this case, the ski is equipped in its support region with an L-shaped piece 45, one flank 46 of which bears on the upper face of the ski and the other flank 47 of which is arranged vertically along one of the side walls of the ski and bears on the lower assembly. The flank 47 is located on the inner wall side, when considering a pair of skis in which the two skis are laid flat one beside the other.

Figure 9:
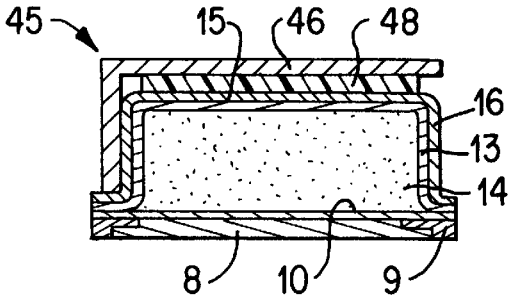

FIG. 9 represents an alternative embodiment of the device in FIG. 8, in which a layer 48 of viscoelastic material is interposed between the upper face of the ski and the flank 46 of the piece 45.

Figure 10:
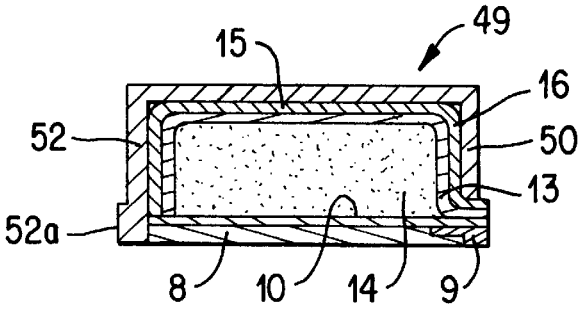

FIG. 10 represents another embodiment of this ski, having a piece 49 of U-shaped cross section, similar to the piece 17 in FIG. 5. In this case, one of the vertical branches 50 of the U rests on the lower assembly of the ski, while the other branch 52 of the U is applied against the lower assembly and constitutes, by means of its lower end 52*a,* the rigid lower corner of a cross-country ski or the edge of the ski, in the case of an alpine ski which has edges, as is the case in FIG. 10.

Figure 11:
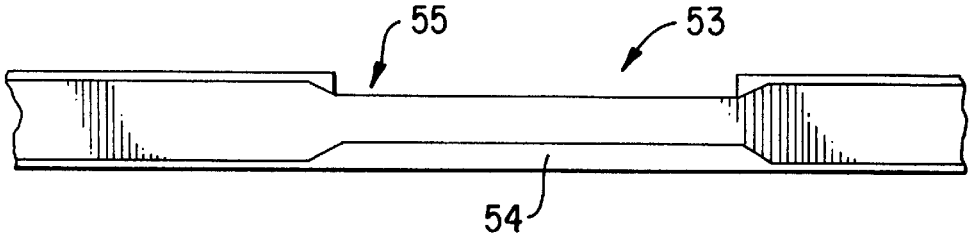
FIG. 11 is a plan view of another embodiment of this ski.

FIG. 11 represents, in plan view, a ski 53 having shell whose side walls are substantially perpendicular to the sole of the ski and to the upper face of the latter. In this case, in the support region, the shell has two inward recesses 54, each intended to make it possible to accommodate the feet and the elements for connecting the latter to the upper wall or platform intended for mounting the binding.

This ski also has an indentation 55 making it possible to house the lower end 52*a* of the device 49 (FIGURE).

As can be seen from the above description, the invention provides a great improvement to the prior art by providing a ski which is equipped with a platform and whose structure is such that the transfer of forces between the snow and the boot binding takes place as directly as possible at the lower corners of the ski.

As is obvious, the invention is not limited just to those embodiments of this ski which have been described above by way of examples, but instead encompasses all variants thereof.

Thus, in particular, the upper element or platform could be fitted into the upper face of the ski, or else the invention could relate to a different type of gliding board, such as a cross-country ski, a monoski or a snowboard, without thereby departing from the scope of the invention.

I claim:

1. A board for gliding on snow, including a device positioned in a support region of the board for mounting a boot binding, wherein the board comprises a lower assembly including a sole bordered by lower metal edges and an upper assembly including one or more filler cores, at least one reinforcing element and an outer shell forming an upper wall and side walls of the board, said device being rigid and substantially nondeformable when the board glides on snow, and comprising:

at least one lower portion located on at least one side of the board, said lower portion bearing on said lower assembly;

at least one upper portion arranged proximate to the upper wall of the board, said upper portion defining a rigid platform for mounting said binding; and at least one connecting portion rigidly connecting each lower portion and each upper portion, said connecting portion being arranged along an outside surface of the board;

wherein each lower portion bears on, either directly or through the outer shell, the corresponding lower metal edge of the board so as to avoid vertical loading of the one or more filler cores, and in the region of the board for mounting a boot binding, the side walls of the board are substantially perpendicular to the sole.

2. The board as claimed in claim 1, wherein said at least one lower portion bears directly on said lower assembly.

3. The board as claimed in claim 1, wherein said at least one lower portion laterally covers said lower assembly.

4. The board as claimed in claim 1, wherein, in the support region, the shell has inward recesses forming passages for each said lower portion, connecting portion, and upper portion.

5. The board as claimed in claim 1 wherein, in each region of the shell intended to accommodate the at least one lower portion, each lower portion defines a horizontal surface used for supporting said lower portion.

6. The board as claimed in claim 1, wherein the lower portion, connecting portion, and upper portion comprise a monobloc piece having a generally L-shaped cross-section, a first flank of which is associated with the upper wall of the board and a second flank of which is associated with one of the side walls of the board.

7. The board as claimed in claim 6, wherein the upper portion forming the platform is arranged above the upper face of the board, and a layer of viscoelastic material is interposed between the upper face of the board and the platform.

8. The board as claimed in claim 1, wherein each lower portion, each connecting portion, and each upper portion extend over the entire length where the boot binding is mounted, the upper element forming a continuous platform.

9. The board as claimed in claim 1, wherein each connecting portion and each lower portion of the device include slots, distributed over the length of said device and terminating at a lower extremity of said device, said slots being substantially perpendicular to the lower element.

10. The board as claimed in claim 1, wherein said upper portion is longer than the connecting portion and the lower portion.

11. The board as claimed in claim 1, wherein the device for mounting the binding is asymmetrical with respect to a longitudinal mid-plane of the board.

12. The board as claimed in claim 11, wherein the board and device include first and second longitudinal sides, the device having a different number of said connecting portion and said lower portion on said first longitudinal side as on said second longitudinal side, and wherein each said connecting portion and said lower portion, on said first longitudinal side is positioned at a different longitudinal point on the board than each said connecting portion and said lower portion on said second longitudinal side.

13. The board as claimed in claim 11, wherein said upper portion is longer than said lower portion.

14. The board as claimed in claim 1, wherein the side walls have an upward and inward inclination in a first portion of the support region, the side walls approach a perpendicular relation to the sole in a second portion of the support region, which results in a reduction in the width of the upper assembly proximate the lower part of the body of the board, and the reduction creates an enlarged area for each said lower portion on the lower assembly of the board.

15. A board for gliding on snow, including a device positioned in a support region of the board for mounting a boot binding, wherein the board comprises a lower assembly including a sole bordered by lower metal edges and an upper assembly including one or more filler cores a reinforcing element and an outer shell forming an upper wall and side walls of the board, said device comprising:

at least one lower portion located on at least one side of the board, said lower portion bearing on said lower assembly;

at least one upper portion arranged proximate to the upper wall of the board, said upper portion defining a rigid platform for mounting said binding; and at least one connecting portion rigidly connecting each lower portion and each upper portion said connecting portion being arranged along an outside surface of the board, wherein each lower portion abuts, either directly or through the outer shell, the corresponding lower metal edge of the board so as to avoid vertical loading of the one or more filler cores, and wherein, in the support region, the shell has inward recesses forming passages for each said lower element and each said connecting element.

16. A board for gliding on snow, including a device positioned in a support region of the board for mounting a boot binding, wherein the board comprises a lower assembly including a sole bordered by lower metal edges and an upper assembly including one or more filler cores, at least one reinforcing element and an outer shell forming an upper wall and side walls of the board, said device being rigid and nondeformable, and comprising:

at least one lower portion located on at least one side of the board, said lower portion bearing on said lower assembly;

at least one upper portion arranged proximate to the upper wall of the board, said upper portion defining a rigid platform for mounting said binding; and at least one connecting portion rigidly connecting each lower portion and each upper portion, said connecting portion being arranged along an outside surface of the board; wherein each lower portion bears, either directly or through the outer shell, on an upper surface of the corresponding lower metal edge of the board so as to avoid vertical loading of the one or more filler cores.

17. The board as claimed in claim 16, wherein said at least one lower portion bears on said lower assembly via said shell.

18. The board as claimed in claim 16, wherein said at least one upper portion is arranged above said upper wall of the board.

19. The board as claimed in claim 16, wherein said at least one upper portion has a surface that contacts said upper wall of the board.

20. The board as claimed in claim 16, wherein the lower assembly further comprises a reinforcing element.

21. The board as claimed in claim 16, wherein said at least one lower portion comprises two lower portions, and said lower portions, connecting portion, and platform comprise at least one monobloc piece having an inverted generally U-shaped cross-section.

22. The board as claimed in claim 16, wherein the side walls have an upward and inward inclination in a region of the board other than the region of the board for mounting a boot binding.

23. The board as claimed in claim 16, wherein the device comprises a front portion and a rear portion separated from the front portion, the front portion being used for mounting a toe piece and the rear portion being used for mounting the heel piece of the binding.

24. The board as claimed in claim 16, wherein the boot binding is a standard boot binding.

25. The board as claimed in claim 16, wherein the upper portion includes a slide channel forming a base to accommodate one of the boot binding, a toe piece of the binding, or a heel piece of the binding.

26. The board as claimed in claim 16, wherein each lower portion bears only on a peripheral portion of the upper surface of the lower metal edges of the board.

* * * * *

UNITED STATES PATENT AND TRADEMARK OFFICE

CERTIFICATE OF CORRECTION

PATENT NO. : 5,944,336
DATED : August 31, 1999
INVENTOR(S) : Jacques FAGOT

It is certified that error appears in the above-identified patent and that said Letters Patent is hereby corrected as shown below:

On the face of the patent at [30], please delete the Foreign Application Priority Date, and insert the following:

--[30] Foreign Application Priority Data

May 22, 1995 [FR] France.....95 06336--

Signed and Sealed this

Thirteenth Day of June, 2000

*Attest:*

Q. TODD DICKINSON

*Attesting Officer*

*Director of Patents and Trademarks*